US009192213B2

(12) United States Patent
Lin et al.

(10) Patent No.: US 9,192,213 B2
(45) Date of Patent: Nov. 24, 2015

(54) ADJUSTABLE CANE WITH MEMORY FUNCTION

(71) Applicants: Ching-Ming Lin, Taichung (TW); Szu-Yuan Huang, Taichung (TW); Yu-Zen Tseng, Taichung (TW); Yu-Ju Chen, Taichung (TW)

(72) Inventors: Ching-Ming Lin, Taichung (TW); Szu-Yuan Huang, Taichung (TW); Yu-Zen Tseng, Taichung (TW); Yu-Ju Chen, Taichung (TW)

(73) Assignees: FOOTWEAR & RECREATION TECHNOLOGY RESEARCH INSTITUTE, Taichung (TW); Ching-Ming Lin, Taichung (TW)

( * ) Notice: Subject to any disclaimer, the term of this patent is extended or adjusted under 35 U.S.C. 154(b) by 0 days.

(21) Appl. No.: 13/938,234

(22) Filed: Jul. 10, 2013

(65) Prior Publication Data

US 2015/0013735 A1 Jan. 15, 2015

(51) Int. Cl.

| | |
|---|---|
| ***A45B 9/00*** | (2006.01) |
| ***A45B 3/12*** | (2006.01) |
| ***A45B 9/04*** | (2006.01) |

(52) U.S. Cl.

CPC .... *A45B 9/00* (2013.01); *A45B 9/04* (2013.01)

(58) Field of Classification Search

USPC ..... 135/65–66, 69, 75; 248/188.5; 403/107–108, 109.1–109.3; 482/67, 482/77; 280/819, 823

See application file for complete search history.

(56) References Cited

U.S. PATENT DOCUMENTS

| | | | | |
|---|---|---|---|---|
| 2,528,706 | A * | 11/1950 | Osborn | 135/69 |
| 4,341,381 | A * | 7/1982 | Norberg | 482/67 |
| 4,809,725 | A * | 3/1989 | Champigny | 135/75 |
| 4,834,366 | A * | 5/1989 | Hotchkiss | 482/122 |
| 4,917,126 | A * | 4/1990 | Ellmore | 135/69 |
| 6,668,846 | B2 * | 12/2003 | Meador | 135/65 |
| 7,293,934 | B1 * | 11/2007 | Huang | 403/109.1 |
| 8,683,657 | B2 * | 4/2014 | Lin | 16/429 |
| 2004/0226593 | A1 * | 11/2004 | Robitaille et al. | 135/77 |
| 2007/0003361 | A1 * | 1/2007 | Wang | 403/109.3 |
| 2007/0251560 | A1 * | 11/2007 | Moore | 135/66 |

FOREIGN PATENT DOCUMENTS

| | | | | |
|---|---|---|---|---|
| JP | 07313229 | A * | 12/1995 | A45B 3/04 |

* cited by examiner

*Primary Examiner* — Winnie Yip

(57) ABSTRACT

A cane includes a tube, an extension rod telescopically mounted within one end of the tube, and a control mechanism sandwiched between the tube and the extension rod. The tube defines a first aperture and a second aperture. The extension rod defines a plurality of holes. The control mechanism is movable among a first position where the control mechanism is positioned in a selected one of the holes in the extension rod, and the tube, the extension rod and the control mechanism are prohibited from moving axially with respect to one another; a second position where the extension rod and the control mechanism together are allowed to move axially with respect to the tube; and a third position where the extension rod is allowed to move axially with respect to the control mechanism and the tube.

14 Claims, 12 Drawing Sheets

ADJUSTABLE CANE WITH MEMORY FUNCTION

BACKGROUND OF THE INVENTION

1. Field of the Invention

This invention relates generally to an adjustable cane, and more particularly, to an adjustable cane having a memory function that allows a user to set a desired length. Therefore, a user does not need to adjust the length every single time after folding.

2. Description of the Related Art

Canes, such as crutches, are well known for helping a user to walk and support the body in an erect position. A conventional cane assembly 900, as shown in FIG. 12, comprises an upper handle portion 91, secured to an elongated tubular, hollow upper body portion 92, telescopically mounted within an elongated tubular, hollow lower body portion 93. A plurality of openings 94 are provided in the elongated hollow lower body portion 93 whereby a spring-loaded button 95, which is movably secured interiorly of the hollow inner portion of upper body portion 92, can be pressed inwardly to allow the lower body portion 93 to move with respect to the upper body portion 92, and the button 95 is locked at the next aligned openings 94. In this manner the overall length of the cane 900 may be easily adjusted to accommodate different sized people.

However, many people who use canes are afflicted with some type of ailment or have other memory problems that make it difficult for these people to adjust the overall length of a cane. For example, when the cane is extended (from its retracted condition) for use, senile people may not remember how to properly adjust the cane to the proper height. Thus, it often takes much time for them just to adjust the length of the cane to fit their needs. Moreover, they will have to face the same problem from time to time as long as the cane is retracted back to its shortest length (for storage).

SUMMARY OF THE INVENTION

To solve the problems mentioned above, the objective of the present invention is to provide a streamlined, adjustable cane with memory function. It allows a user to set a desired length so the cane can be extended directly to the desired length whenever is needed.

Specifically, the cane includes a tube, an extend rod telescopically mounted within one end of the tube, and a control mechanism disposed in between an inner wall of the tube and an outer wall of the extension rod. The tube defines a first aperture and a second aperture spaced in a side thereof. The extension rod defines a plurality of holes in a side thereof. The control mechanism is movable among positions. While the control mechanism is in the first position, the control mechanism is positioned in a selected one of the holes in the extension rod and exposed in the first aperture in the tube, and the tube, the extension rod and the control mechanism are prohibited from moving axially with respect to one another. As such, the cane can be used to aid walking if it is extended in a proper height. While the control mechanism is in the second position, the extension rod and the control mechanism together are allowed to move axially with respect to the tube, which means the cane is allowed to be retracted back to its shortest length for storage or be moved to the third position for setting. While the control mechanism is in the third position, the control mechanism is exposed in the second aperture in the tube, and the extension rod is allowed to move axially with respect to the control mechanism and the tube. At this time, the cane enters a memory change mode where the extension rod is adjustable to have the control mechanism engaged in a new selected one of the holes in the extension rod in order to cause a change in the total length of cane. This ensures that next time the cane is extended (from its retracted condition), the cane is extended to the changed total length as desired.

DETAILED DESCRIPTION OF EMBODIMENTS

Figure 1:
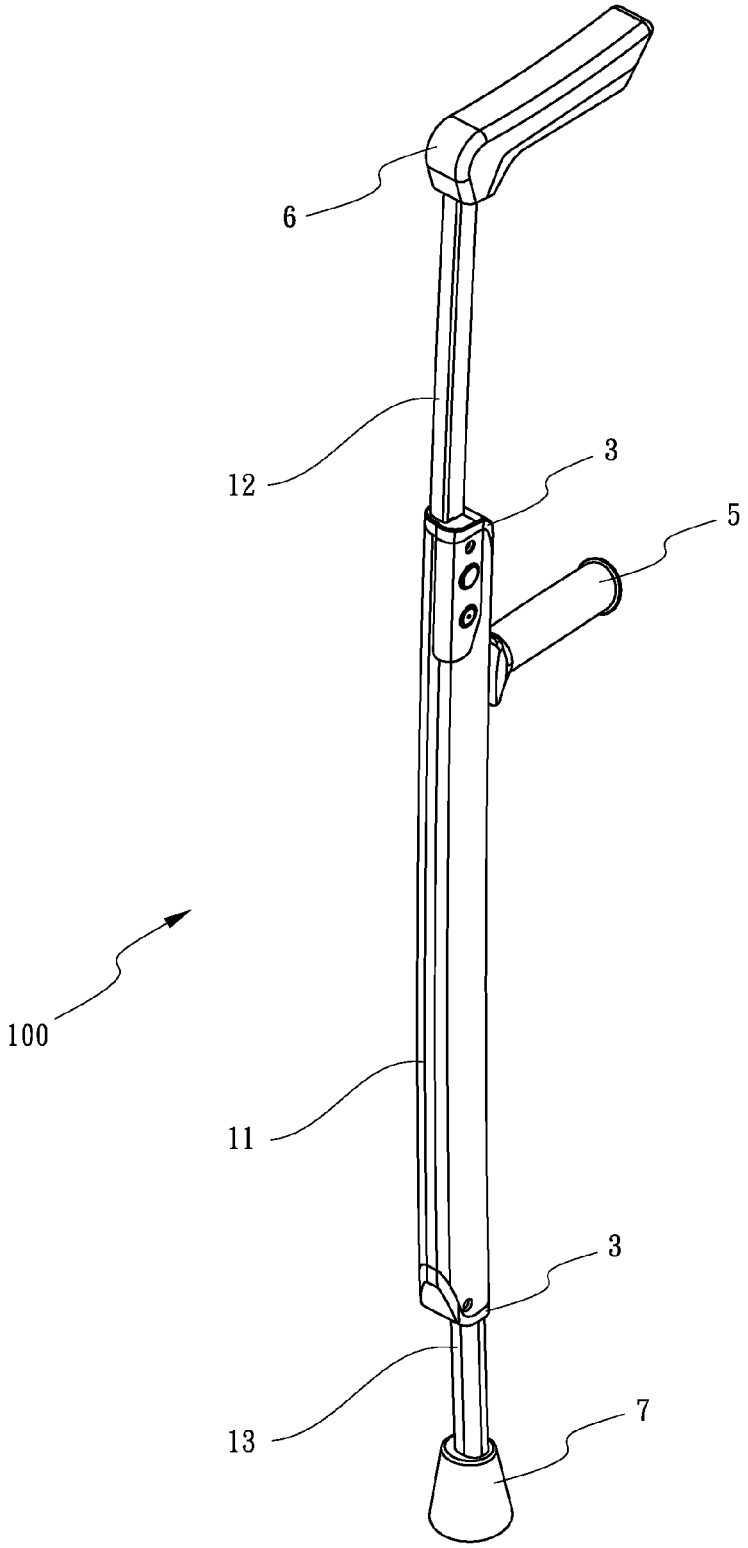
FIG. 1 is a perspective view of a cane in accordance with the preferred embodiment of the present invention.
Figure 2:
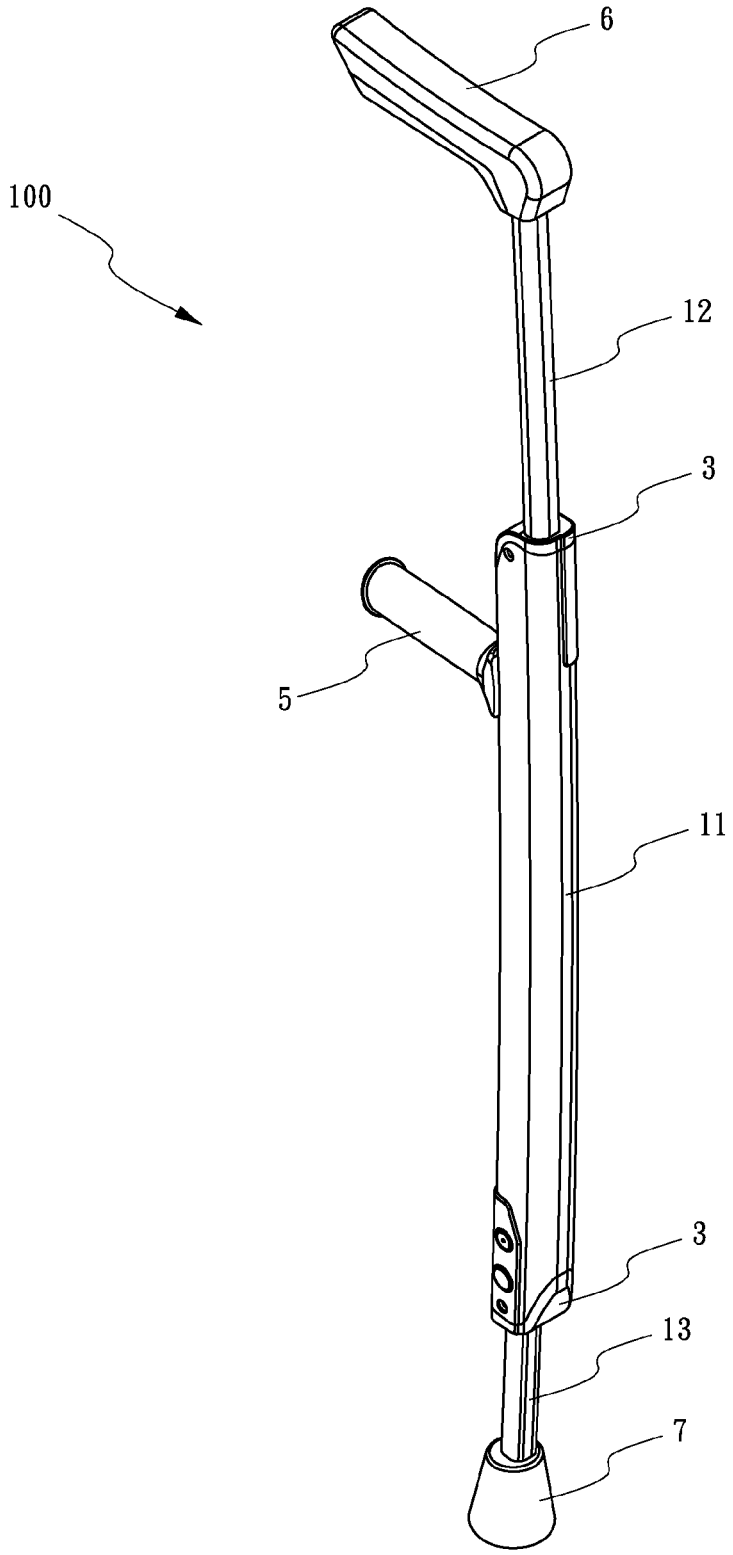
FIG. 2 is another perspective view of the cane shown in FIG. 1, taken from another angle.

Referring to the drawings to FIGS. 1-11, a cane 100 is provided in accordance with the preferred embodiment of the present invention. As shown in FIG. 1 or 2, the cane 100 is an underarm auxiliary crutch and generally includes a tube 11, an upper extension rod 12 telescopically mounted within an upper end of the tube 11, a lower extension rod 13 telescopically mounted within a lower end of the tube 11, an underarm support 6 laterally extending from a top end of the upper extension rod 12, a handle 5 laterally extending from a side of the tube 11 and a rubber tip 7 mounted to a bottom end of the lower extension rod 13.

Figure 3:
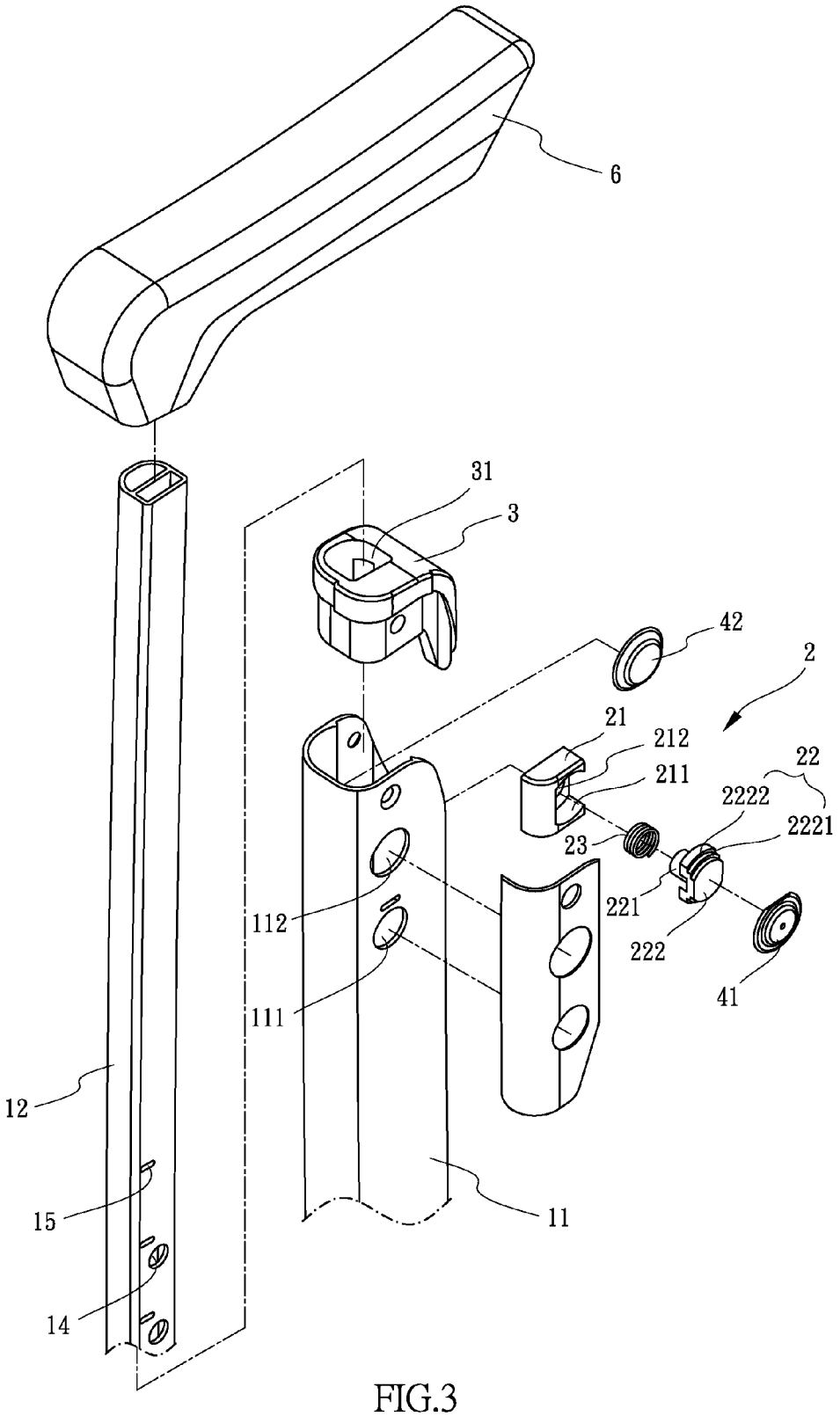
FIG. 3 is a partial exploded perspective view of the cane shown in FIG. 1.

Referring to FIG. 3, the tube 11 defines a first aperture 111 and a second aperture 112 spaced a distance apart in an upper side thereof. The second aperture 112 of the tube 11 is larger in diameter than the first aperture 111 of the tube 11. Preferably, a first flexible cap 41 is sized and shaped to cover the first aperture 111 in the tube 11, and a second flexible cap 42 is sized and shaped to cover the second aperture 112 in the tube 11 for protection. The upper extension rod 12 defines a plurality of holes 14 in a side thereof.

Moreover, the cane 100 further includes a control mechanism 2 for controlling movement of the tube 11 and the extension rod 12. There are an identical control mechanism and other two apertures presented at the other end of the tube 11. As it is identical, only the upper control mechanism 2 is described.

Figure 4:
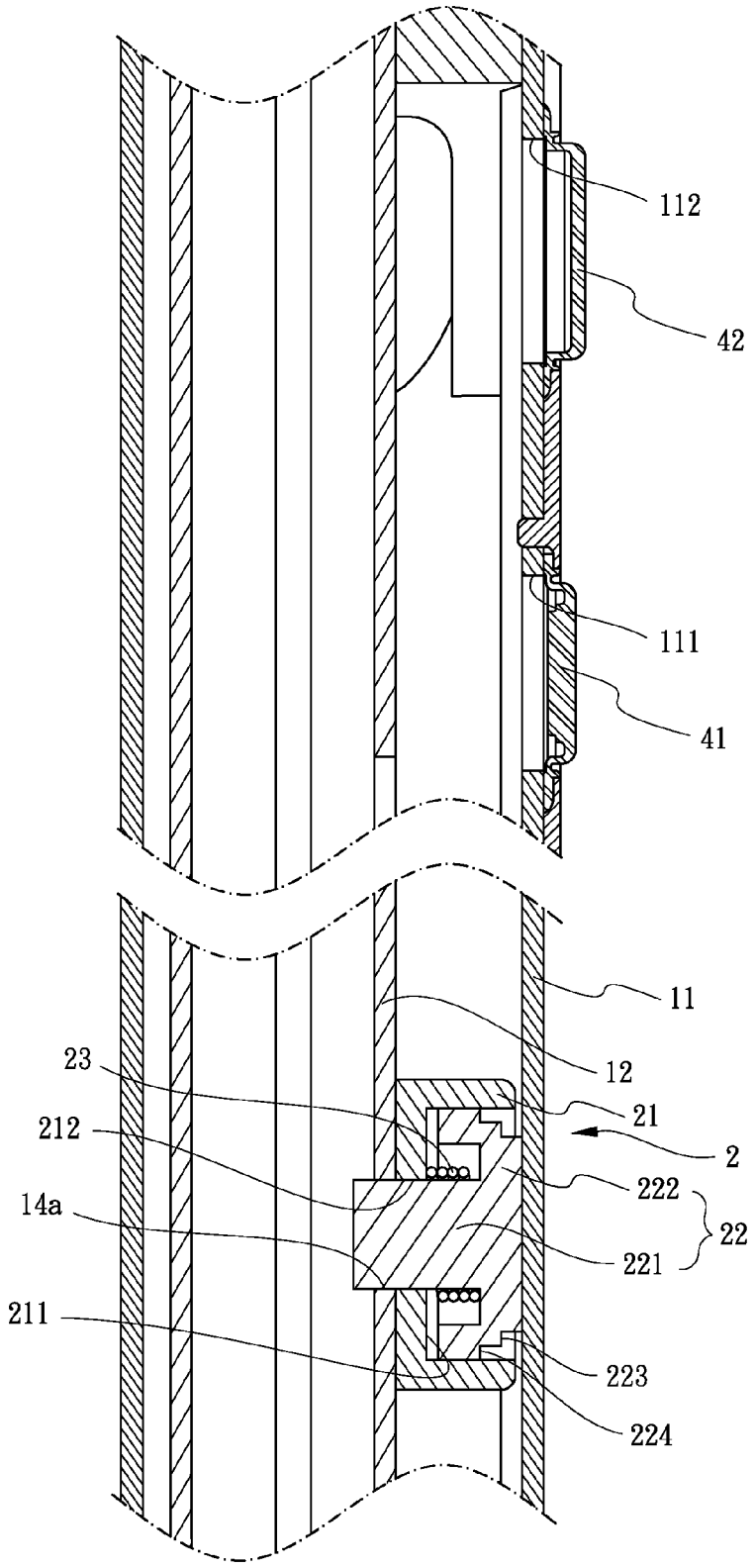
FIGS. 4-10 are partial enlarged cross-sectional views of the cane shown in FIG. 1, showing the process of adjusting the cane.

As shown in FIG. 3, the control mechanism 2 includes a carrier 21, a button 22 and a spring 23. As shown in FIG. 4, the carrier 21 is slidably sandwiched between the inner wall of the tube 11 and the outer wall of the extension rod 12. The button 22 is seated in a recess 211 of the carrier 21 and includes a head 222 and a pin 221. The head 222 of the button 22 is provided to be at least partly received in the first aperture 112 in the tube 11. The pin 221 has one end joined to the head 222, and the other end extends through a transverse bore 212 in a bottom of the recess 211 of the carrier 21 to be engaged in a selected one **14*a* of the holes in the extension rod 12. When the cane 100 is in a retracted position, as depicted in FIG. 4, the pin 221 of the button 22 passes through the transverse bore 212 of the carrier 21 and into the hole 14*a* of the extension rod 12. The spring 23 is assembled around the pin 221 and braced in the recess 211 of the carrier 23 for normally biasing the button 22 toward the inner wall of the tube 11. In particular, the head 222 of the button 22 has a stepped shape with a first outer shoulder 223 and a second larger shoulder 224 corresponding to the first aperture 111 and the second aperture 112 in the tube 11**.

Figure 5:
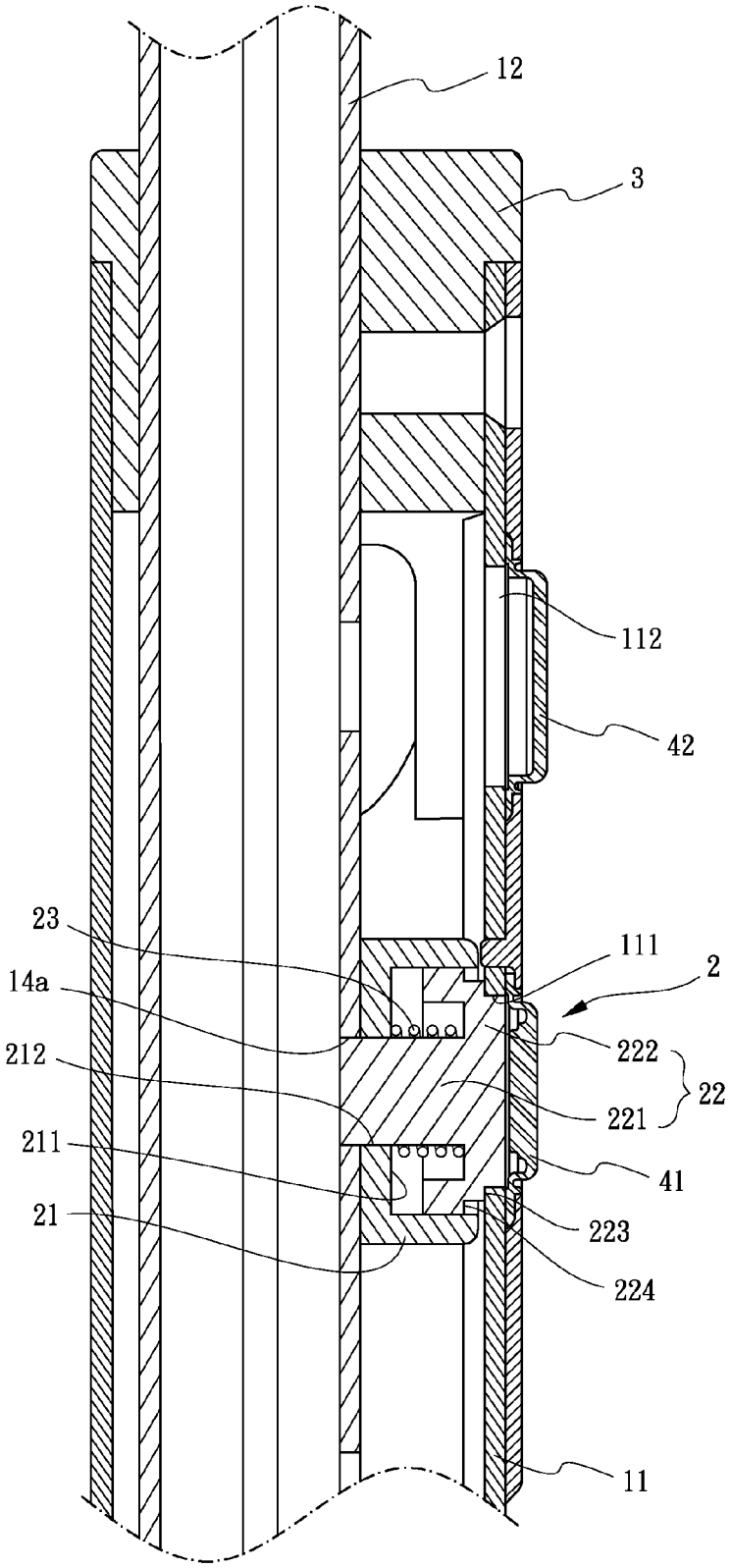

In operation, the cane 100 is adjusted from the retracted position (FIG. 4), for storage, to an extended position (FIG. 5), for use. Specifically, the control mechanism 2 together with the extension rod 12 moves from a lower original position (FIG. 4) to an upper, first position (FIG. 5) where the control mechanism 2 remains positioned in the selected hole 14*a* in the extension rod 12 and exposed in the first aperture 111 in the tube 11. As shown in FIG. 5, when the control mechanism 2 is in the first position, the control mechanism 2 has a first end, namely the head 222, laterally engaged in the first aperture 111 in the tube 11 and a second end, namely the pin 221, laterally engaged in the selected hole 14*a* in the extension rod 12 such that the tube 11, the extension rod 12 and the control mechanism 2 are prohibited from moving axially with respect to one another. Specifically, the head 222 of the button 22 is partly engaged in the first aperture 111 in the tube 11 with its first outer shoulder 223 abutting against the inner wall of the tube 11. On the other hand, the pin 221 of the button 22 is engaged in the selected hole 14*a* in the extension rod 12. As such, the cane 100 is extended with a predetermined length and is ready to be used for walking. However, if the user is not satisfied with the length of the cane 100, the cane 100 may be further adjusted as described below.

Figure 6:
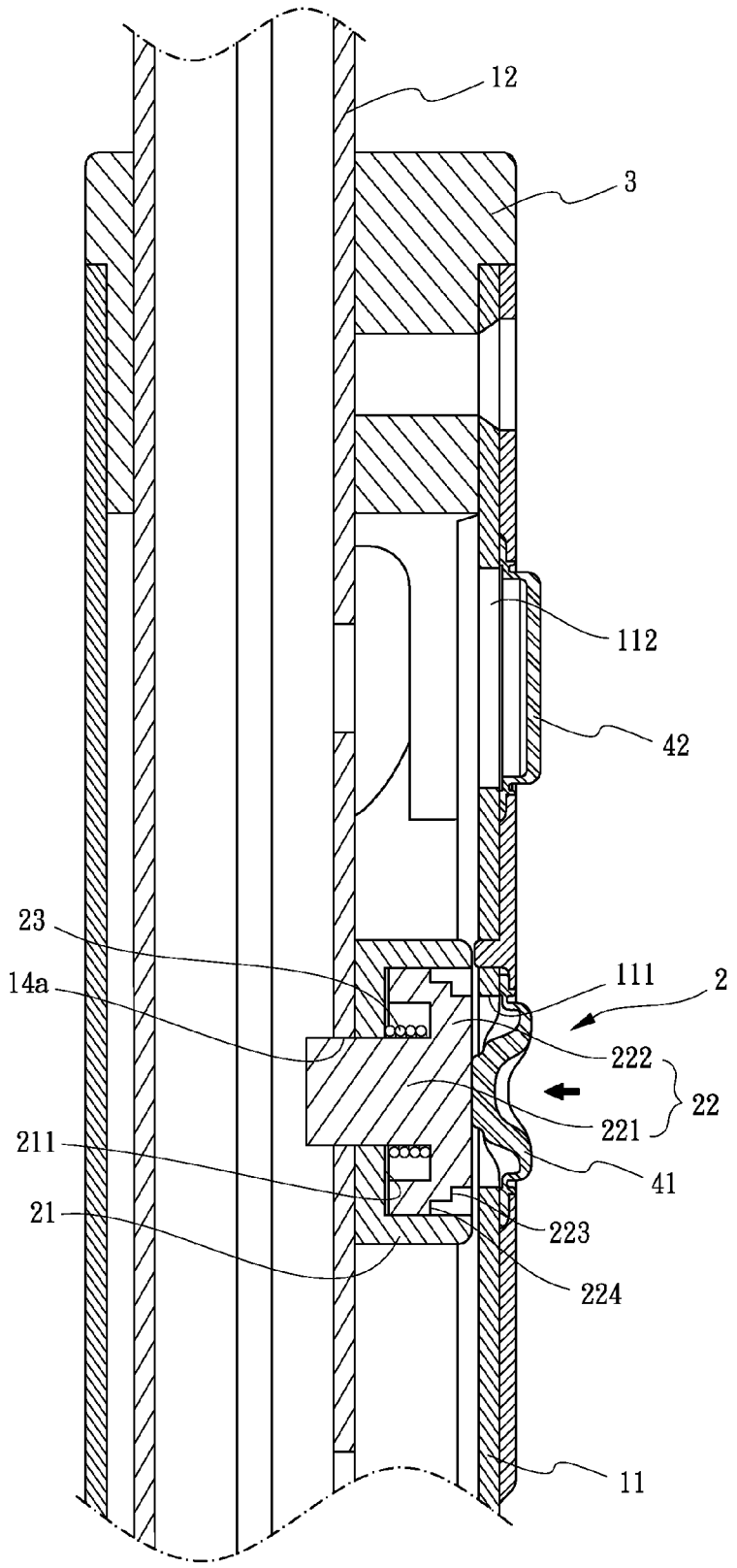
Figure 7:
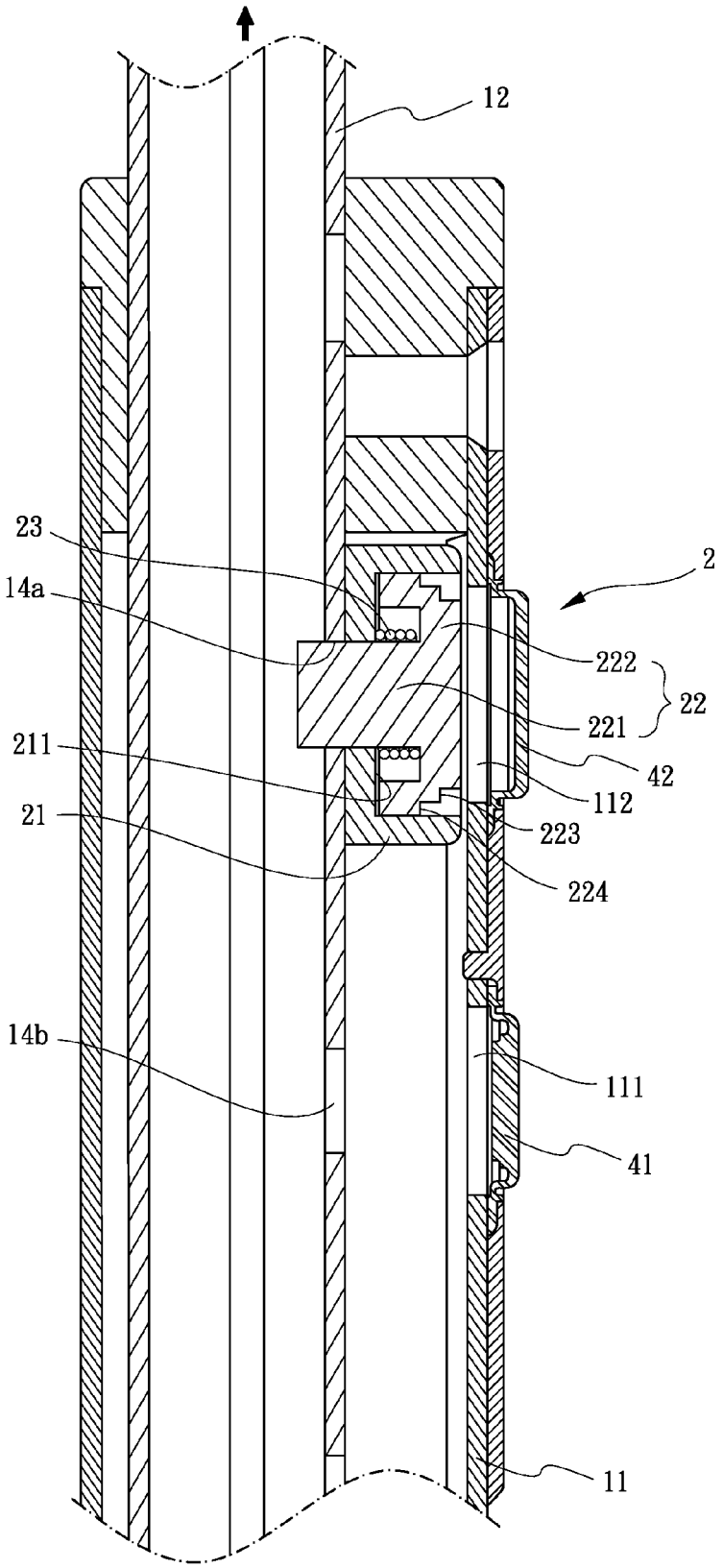
Figure 8:
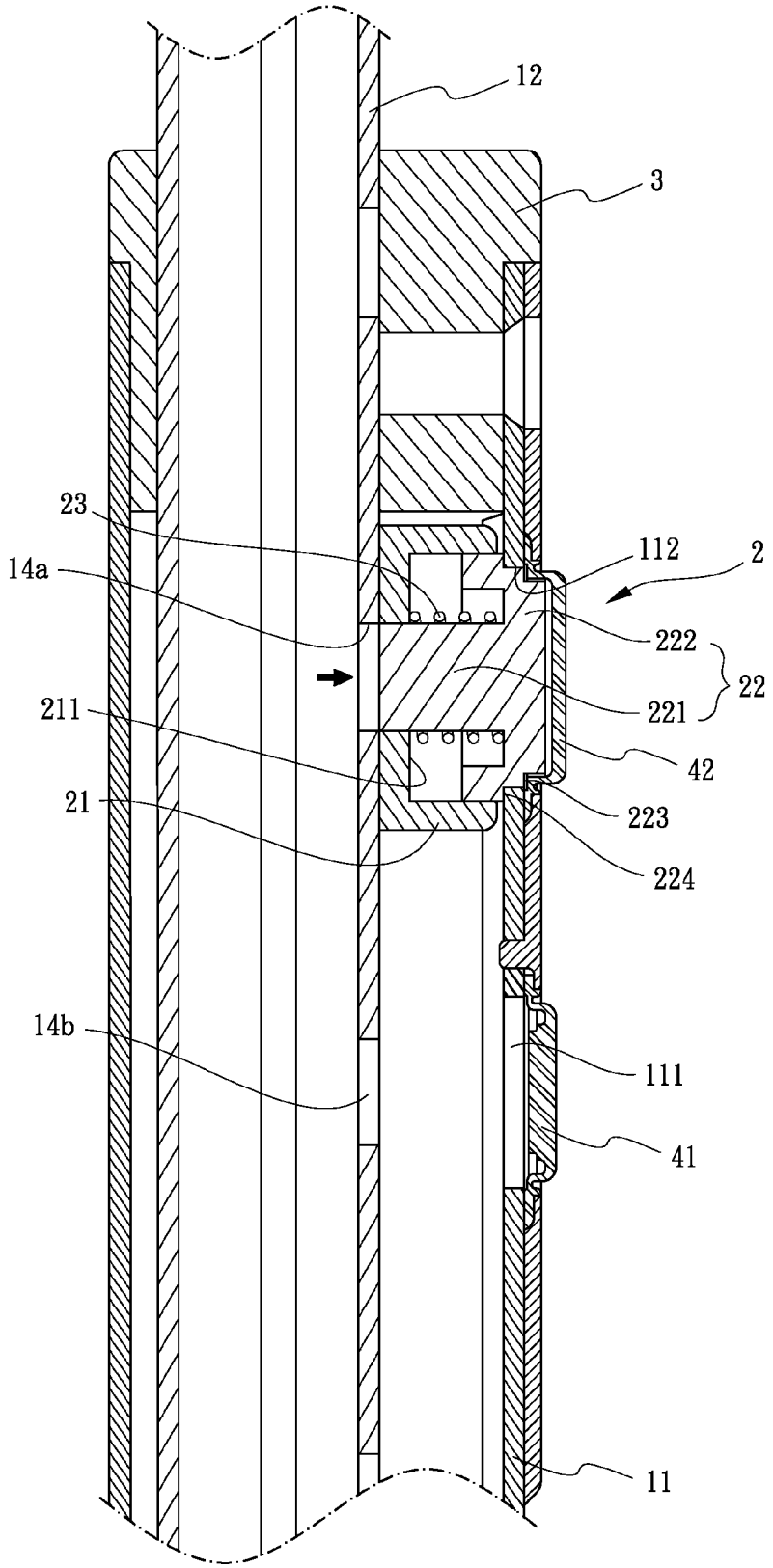
Figure 11:
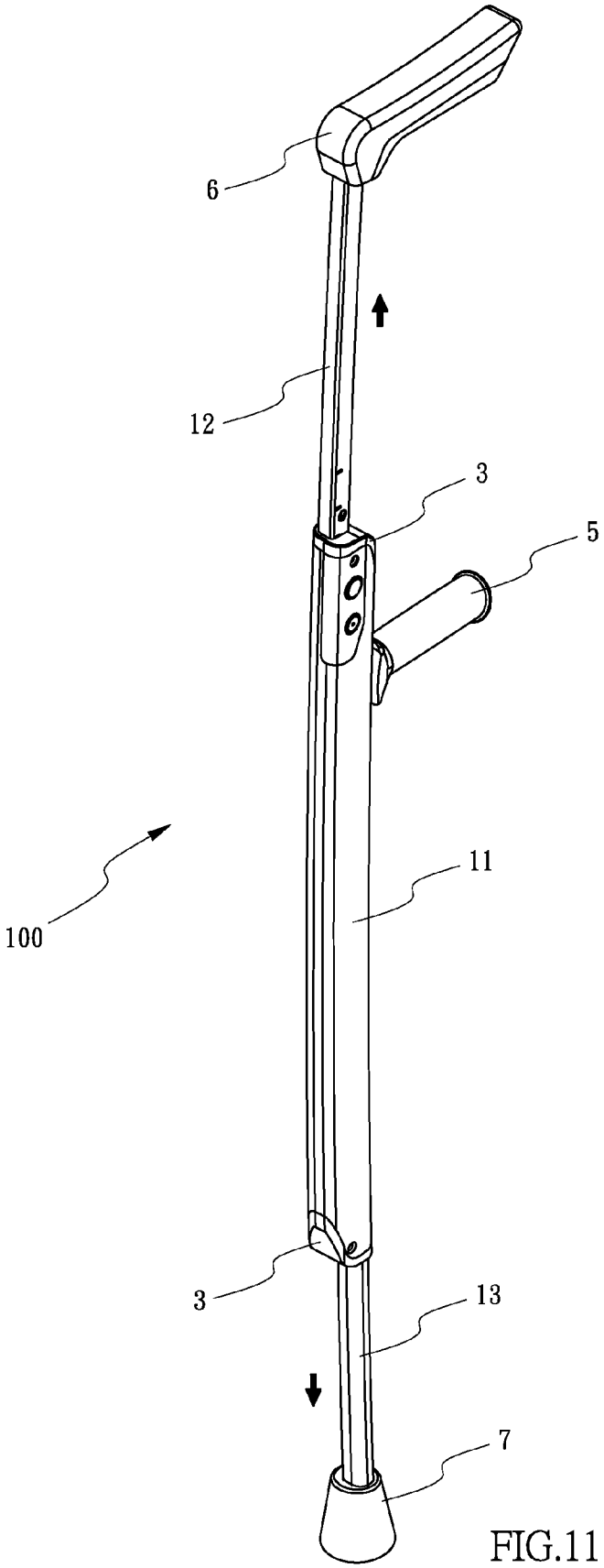
FIG. 11 illustrates that the cane in FIG. 1 is extended to a desired length.
Figure 12:
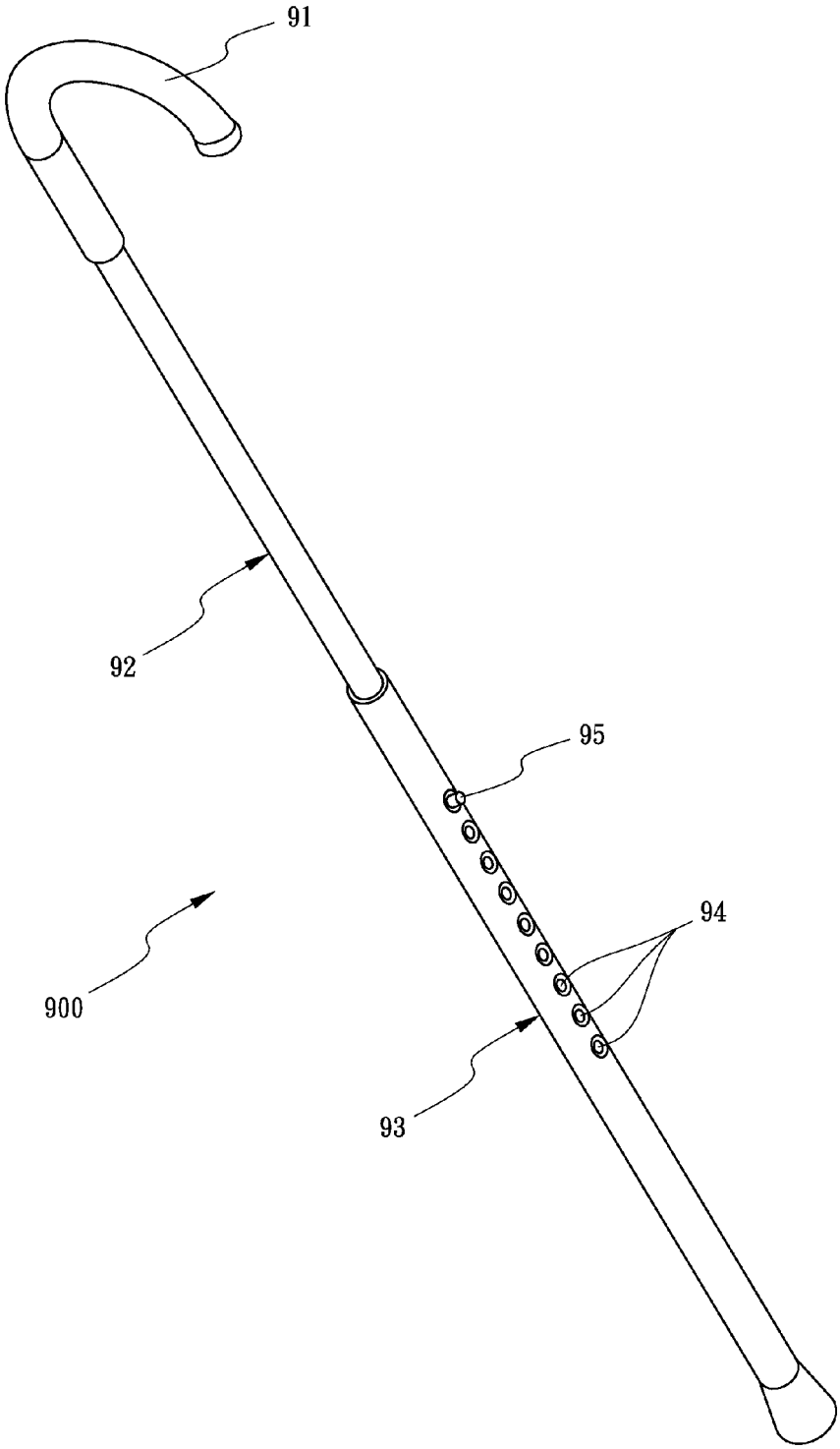
FIG.12 (Prior art)
FIG. 12 is a prior art.

With reference to FIG. 6, by pushing the button 22 from outside of the first flexible cap 41, as indicated by the arrow, the control mechanism 2 may be moved laterally from the first position (FIG. 5) to a second position (FIG. 6) where the first end of the control mechanism 2, namely the head 221, is withdrawn from the first aperture 111 in the tube 11 such that the extension rod 12 and the control mechanism 2 together are allowed to move axially with respect to the tube 11. That is, the control mechanism 2 is ready to move with the extension rod 12 from the second position (FIG. 6) up to a third position (FIG. 8) via a transition position (FIG. 7) where the control mechanism 2 is exposed in the second aperture 112 in the tube 11. More specifically, upon the control mechanism 2 arrives in the transition position, as shown in FIG. 7, the button 22 of the control mechanism 2 is pushed by the spring 23 toward the tube 11 such that the control mechanism 2 laterally moves from the transition position (FIG. 7) to the third position (FIG. 8) where the first end of the control mechanism 2, namely the head 222, is engaged in the second aperture 112 of the tube 11 and the second end of the control mechanism 2, namely the pin 221, is completely withdrawn from the selected hole 14*a*. Thus, the extension rod 12 is released from the control mechanism 2 and therefore allowed to move axially with respect to the control mechanism 2 and the tube 11. More specifically, the head 222 of the button 22 is partly engaged in the second aperture 112 in the tube 11 with the second enlarged shoulder 224 abutting against the inner wall of the tube 11. Since the extension rod 12 is released from the control mechanism 2, the cane 100 is allowed to be adjusted to change its total length by moving the extension rod 12. For example, the extension rod 12 may be pulled upward or outward, as shown in FIG. 11, with respect to the control mechanism 2 and the tube 11 to a desired position where a new selected hole 14*b* of the extension rod 12, instead of the hole 14*a*, is aligned with the pin 221 of the button 22 of the control mechanism 2, as depicted in FIG. 9.

In order to prevent the extension rod 12 from being completely detached from the tube 11, a stop member 3 is provided to be mounted on the upper end of the tube 11 to block the control mechanism 2 so that the extension rod 12 will not come off the tube 11. As best seen in FIG. 3, the stop member 3 defines, from top to bottom, a passage 31 through which the extension rod 12 extends.

Figure 9:
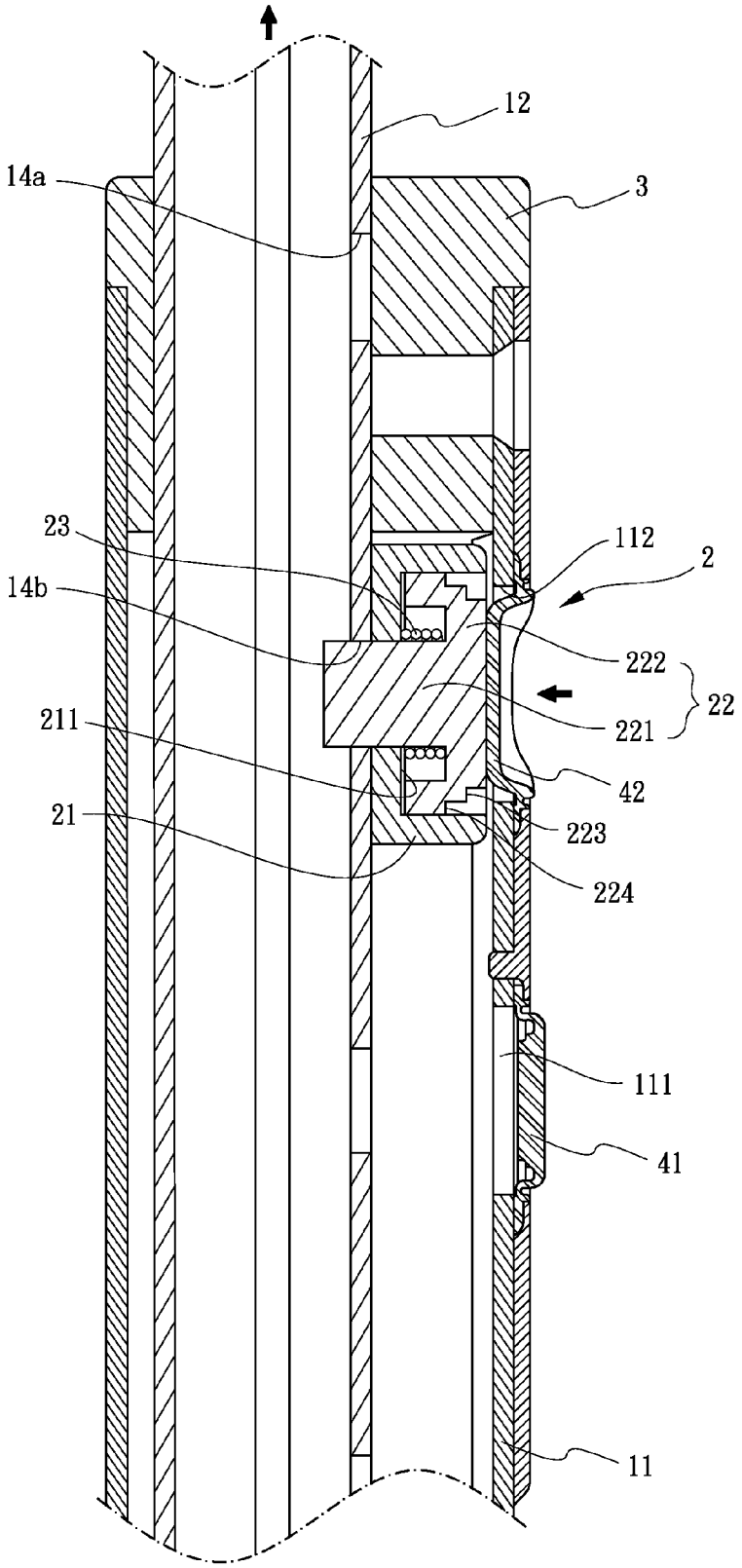
Figure 10:
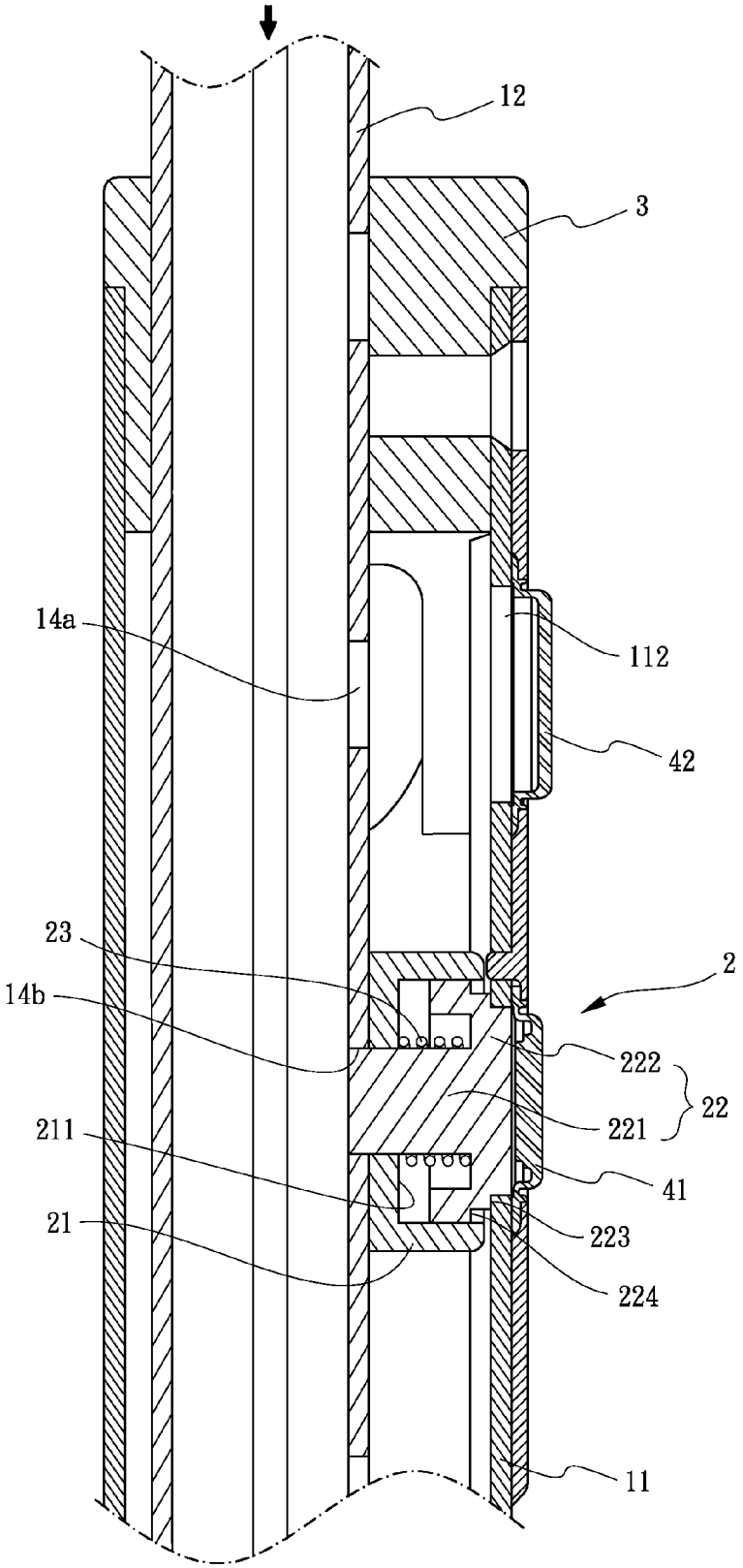

As shown in FIG. 9, the control mechanism 2 may then be pushed inward from outside of the second flexible cap 42, as indicated by the arrow, to have the pin 221 of the button 22 be re-engaged in the new selected hole 14*b* in the extension rod 12 and have the head 222 of the button 22 withdrawn from the second aperture 112 in the tube 11. This means that the cane 100 is reset to have a desired total length. The extension rod 12 together with the control mechanism 2 may then be pushed downward to have the new selected hole 14*b* and the control mechanism 2 together laterally aligned with the first aperture 111 in the tube 11, as shown in FIG. 10, for use. At this time, the total length of the cane 100 has been changed to the desired total length. Alternatively, the extension rod 12 together with the control mechanism 2 may pass by the first aperture 111 in the tube 11 and down to a lowest position to have the cane 100 be retracted for storage. It is understood that the next time the cane 100 is extended for use, the cane 100 can be extended directly to the desired total length as the cane 100 memories the user's desire.

Preferably, the extension rod 12 is formed thereon with a plurality of alignment marks 15, as shown in FIG. 3, spaced along a length of the extension rod 12 and corresponding to the holes 14 in the extension rod 12 to facilitate adjust the length of the cane 100. If one of the alignment marks is aligned with a top edge of the stop member 3, the respective hole 14 in the extension rod 12 is aligned with the second aperture 112 in the tube 11. This helps for alignment between the new selected hole 14*b* in the extension rod 12 and the pin 221 of the button 22 of the control mechanism 2 which is in line with the second aperture 112 in the tube 11, as shown in FIG. 9.

It is to be understood that the disclosed embodiments are illustrative in nature and the invention is not to be limited to any one or more embodiments except as set forth in the following claims.

What is claimed is:

1. A cane comprising:

a tube defining a first aperture and a second aperture spaced in a side thereof;

an extension rod telescopically mounted within one end of the tube and defining a plurality of holes in a side thereof; and a control mechanism disposed in between an inner wall of the tube and an outer wall of the extension rod, and being movable to a first position where the control mechanism is positioned in a selected one of the holes in the extension rod and exposed in the first aperture in the tube, and the tube, the extension rod and the control mechanism are prohibited from moving axially with respect to one another; a second position where the extension rod and the control mechanism together are allowed to move axially with respect to the tube; and a third position where the control mechanism is exposed in the second aperture in the tube and the extension rod is allowed to move axially with respect to the control mechanism and the tube.

2. The cane of claim 1, wherein when the control mechanism is in the first position, the control mechanism has a first end laterally engaged in the first aperture in the tube and a second end laterally engaged in the selected hole in the extension rod such that the tube, the extension rod and the control mechanism are prohibited from moving axially with respect to one another.

3. The cane of claim 2, wherein the control mechanism is movable laterally from the first position to the second position where the first end of the control mechanism is withdrawn from the first aperture in the tube such that the extension rod and the control mechanism together are allowed to move axially with respect to the tube.

4. The cane of claim 3, wherein the control mechanism together with the extension rod is axially movable from the second position to a transition position to permit the control mechanism laterally moving to the third position where the first end of the control mechanism is engaged in the second aperture of the tube and the second end of the control mechanism is withdrawn from the selected hole such that the extension rod is allowed to move axially with respect to the control mechanism and the tube.

5. The cane of claim 4, wherein the control mechanism includes a carrier sandwiched between the inner wall of the tube and the outer wall of the extension rod, a button seated in the carrier, and a spring disposed in the carrier for normally biasing the button toward the inner wall of the tube; the carrier has a transverse bore; and the button has a head to be at least partly received in the first aperture in the tube, and a pin has one end joined to the head and the other end extending through the transverse bore in the carrier such that when the control mechanism is in the first position, the other end of the pin of the button is engaged in the selected hole in the extension rod and the head of the button is partly engaged in the first aperture in the tube.

6. The cane of claim 5, wherein the head of the button has a stepped shape with a first outer shoulder and a second larger shoulder, and the second aperture of the tube is larger in diameter than the first aperture of the tube; when the control mechanism is in the first position, the head of the button is partly engaged in the first aperture in the tube with the first outer shoulder abutting against the inner wall of the tube; and when the control mechanism is in the third position, the head of the button is partly engaged in the second aperture in the tube with the second enlarged shoulder abutting against the inner wall of the tube.

7. The cane of claim 1, further comprising a stop member mounted on the end of the tube to prevent the extension rod from being detached from the tube, wherein the stop member has a passage defined from top to bottom thereof; and the extension rod extends though the passage of the stop member.

8. The cane of claim 7, wherein the extension rod is formed thereon with a plurality of alignment marks spaced along a length of the extension rod and corresponding to the holes in the extension rod such that if one of the alignment marks is aligned with a top edge of the stop member, the respective hole in the extension rod is aligned with the second aperture in the tube.

9. The cane of claim 1, further comprising a first flexible cap sized and shaped to cover the first aperture in the tube.

10. The cane of claim 9, further comprising a second flexible cap sized and shaped to cover the second aperture in the tube.

11. The cane of claim 1, further comprising an underarm support laterally extending from a top end of the extension rod.

12. The cane of claim 11, further comprising a handle laterally extending from a side of the tube.

13. The cane of claim 1, further comprising another extension rod telescopically mounted within the other end of the tube.

14. The cane of claim 13, further comprising a rubber tip mounted to a bottom end of the another extension rod.

* * * * *